US005801492A

United States Patent [19]

Bobel

[11] Patent Number: 5,801,492

[45] **Date of Patent: *Sep. 1, 1998**

[54] ELECTRONIC BALLAST FOR GAS DISCHARGE LAMP HAVING PRIMARY AND AUXILIARY RESONANT CIRCUITS

[76] Inventor: Andrzej Bobel, 201 Norman Ct., Des Plaines, Ill. 60016

[ * ] Notice: The term of this patent shall not extend beyond the expiration date of Pat. No. 5,434,480.

[21] Appl. No.: 657,647

[22] Filed: May 30, 1996

[51] Int. Cl.[6] ..... H05B 37/00

[52] U.S. Cl. ..... 315/244; 315/224; 315/209 R; 315/200 R; 315/DIG. 7

[58] Field of Search ..... 315/209 R, 224, 315/200 R, 244, 247, 282, 219, 307, DIG. 4, DIG. 7; 363/37, 49, 101, 15, 59, 60

[56] References Cited

U.S. PATENT DOCUMENTS

| | | | |
|---|---|---|---|
| 3,611,021 | 10/1971 | Wallace | 315/239 |
| 4,017,785 | 4/1977 | Perper | 315/DIG. 7 X |
| 4,109,307 | 8/1978 | Knoll | 363/101 |
| 4,210,846 | 7/1980 | Capawell et al. | 315/121 |
| 4,251,752 | 2/1981 | Stolz | 315/206 |
| 4,642,745 | 2/1987 | Steigerwald et al. | 363/37 |
| 4,782,268 | 11/1988 | Fahnrich et al. | 315/200 R |
| 4,808,887 | 2/1989 | Fahnrich et al. | 315/247 |
| 4,950,959 | 8/1990 | Beckrot et al. | 315/219 |
| 4,954,754 | 9/1990 | Nilssen | 315/219 |
| 4,985,664 | 1/1991 | Nilssen | 315/209 R |
| 5,010,277 | 4/1991 | Courier De Mere | 315/200 R |
| 5,049,790 | 9/1991 | Herfurth et al. | 315/291 |
| 5,099,407 | 3/1992 | Thorne | 363/37 |
| 5,103,139 | 4/1992 | Nilssen | 315/219 |
| 5,113,337 | 5/1992 | Steigerwald | 363/98 |
| 5,134,556 | 7/1992 | Courier De Mere | 363/37 |
| 5,150,013 | 9/1992 | Bobel | 315/209 R |
| 5,416,387 | 5/1995 | Cuk et al. | 315/209 R |
| 5,434,480 | 7/1995 | Bobel | 315/224 |

*Primary Examiner*—Robert Pascal
*Assistant Examiner*—Haissa Philogene

[57] ABSTRACT

An electronic ballast to power a gas discharge load (FL1) operating from a low frequency AC voltage source (ACVS) equipped with a dimmer (DIM) and having variable voltage magnitude. The device comprising a primary resonant oscillator (RO1) exhibiting an inductive character of frequency dependent impedance as an auxiliary resonant inductance (La) interacting with an auxiliary resonant capacitance (Ca) coupled to a rectifier circuit (RB, VSD) which performs switching and rectifying functions developed by and synchronized with a pulsating current drawn from the rectifier circuit by the primary oscillator circuit (RO1) equipped with switching transistors (Q1, Q2) and adapted to deliver to the gas discharge load (FL1) high frequency signal to of a variable magnitude proportional to the variable magnitude of the voltage of the AC voltage source.

15 Claims, 7 Drawing Sheets

ELECTRONIC BALLAST FOR GAS DISCHARGE LAMP HAVING PRIMARY AND AUXILIARY RESONANT CIRCUITS

BACKGROUND OF THE INVENTION

1. Field of the Invention

This invention relates to single stage electronic energy converters operated from alternating power line and capable of supplying, at the output, a load such as gas discharge lamp in constant or regulated illumination levels.

2. Description of Prior Art

The electronic energy converters, or as sometimes called "switching power supplies", need to operate directly from the alternating power line. Electric utility companies are setting requirements for specific groups of electricity-powered appliances in regards to power quality drawn by these appliances.

The electronic ballast, as one of the appliances, is used in large quantities in lighting fixtures. In general, to meet the industry requirements in regards to power quality, an electronic ballast has to meet two fundamental requirements: (i) draw power from the power line with power factor (PF) of at least 0.9, (ii) draw current from the power line with total harmonic distortion (THD) of less than 33 percent (as per American National Standard Institute).

The electronic ballast has to meet other requirements related to compatibility with a lamp-load. It shall provide lamp current crest factor of less than 1.7, where the "crest factor" is equal to a peak magnitude of the lamp current divided by its effective (RMS) value. This is related to maximum allowable modulation of the lamp current magnitude, which is responsible for light flicker and poor lamp efficacy expressed in lumens of light produced from each watt of power consumed. It is desirable to have constant power to be delivered to the lamp load over the entire cycle of the voltage supplied by the power line. Most recently, the electronic ballast is expected to operate a lamp with constant or regulated illumination levels in similar way as the ordinary incandescent light bulb is dimmed with an ordinary line voltage phase control dimmer. Also, the market demands electronic ballast which will exhibit very low inrush current to prevent premature failures of the power switching contacts and to maximize number of ballast which can be connected to a single-fused power distribution branch without necessary fuse overrating.

In order to convert the low frequency power line alternating voltage (120V/60 Hz or 220V/50 Hz) to high frequency (typically from 10 kHz to 100 kHz) alternating voltage or current source, one have to rectify the signal from the power line to a DC voltage which later is converted, by switching transistors, to the high frequency source.

Conventional off-line rectifiers have a capacitive smoothing filter located beyond a diode rectifier circuit. This smoothing capacitor causes harmonic distortion of the current waveforms during periods in which the rectified output is higher than the voltage over the smoothing capacitor, and during which time the capacitor charges up. This charging time, or conduction angle, is very small if large capacitor is used, and all the required charge has to be loaded into the capacitor in a short period of time. This results in a large current output from the rectified power line source. These current spikes increase the harmonic content of the power supply, and when large number of ballasts are operated from the power line, this increased harmonic distortion causes a poor power factor in the supply. This situation is not accepted upon by electricity supply authorities and causing interference with other electrical equipment.

Techniques for improving power factor include passive waveform shaping methods. One of them is described in U.S. Pat. No. 5,150,013 issued to BOBEL. This method requires an inductor to operate in resonant mode with a capacitor, and the resonant frequency is approximately 180 Hz when power line frequency is 60 Hz. Is is inexpensive and reliable method. However, the inductor must be large in size.

It is known to use a storage conversion principle, whereby an inductor is controlled at high frequency in order to allow charging of the smoothing capacitor over wide conduction angle. The system, however, requires a control circuit for the storage converter, known also as "boost converter", in order to regulate the discharge of energy from the storage inductor. Such use of the storage conversion principle requires additional noise filtering, because large amount of noise is being generated by switching devices. The circuit is very complex and expensive to produce. Furthermore, the second stage converter is necessary to convert the DC voltage source to the high frequency alternating voltage or current source. This type circuit is described in U.S. Pat. No. 5,049,790 issued to Herfurth.

It is also known to use a single stage converter which draws near sinusoidal current from the sinusoidal power line source, and delivers high frequency current to the lamp-load. In this principle, which uses resonant oscillatory circuit having ability to store and release energy, portion of the resonant energy is redirected from the output to the input of the converter. This method creates large circulating currents within the oscillatory circuits, thus causes large amount of power being dissipated within the converter. The following patents describe single stage inverter which have portion of the energy from the output redirected to the input of the converter, and exhibit large amount of power dissipation:

| U.S. Pat. No. | Patentee |
|---|---|
| 4,017,785 | Perper |
| 4,109,307 | Knoll |
| 4,642,745 | Steigerwald et al. |
| 4,782,268 | Fahnrich et al. |
| 4,808,887 | Fahnrich et al. |
| 4,985,664 | Nilssen |
| 4,954,754 | Nilssen |
| 5,010,277 | Courier de Mere |
| 5,134,556 | Courier de Mere |
| 5,113,337 | Steigerwald |
| 5,099,407 | Thorne |
| 5,103,139 | Nilssen |

It is highly desirable to have a simple and low cost single stage electronic ballast to solve problems of the above inventions and meet all the industry requirements. It is highly desirable to have simple and low cost single stage electronic energy converter. Such a circuit shall have low parts count and cost, it shall be adaptable to all power line voltages and lamps kinds, it shall be easy manufacturable in large quantities with great repeatability as required by industry quality standards, it shall meet the power quality standards and draw power from the power line with near-sinusoidal current waveform and provide near-constant power to the lamp over the entire cycle of power line voltage waveform.

It is further highly desirable to have such an electronic ballast as outlined above and operate a lamp at constant or regulated illumination levels with use of an ordinary incandescent type dimmer.

Furthermore, it is highly desirable to have an electronic ballast which can be made to fit very small spaces and be integrated with a lampholder of a replaceable fluorescent lamp or integrated with said lamp into a single structure.

However, this applicant is not aware of any prior art relevant to an integrated, single stage, simple in construction, and dimmable with an ordinary incandescent dimmer electronic ballast for fluorescent lamps wherein, the energy used to correct the power factor is not redirected from the output to the input of the device.

SUMMARY OF THE INVENTION

An object of the invention is to provide a relatively simple, cost effective, highly reliable and highly efficient electronic ballast for variety of gas discharge loads and power level requirements.

Another object is that of providing integrated into a single stage and operated with high power factor from the power line, an electronic energy converter providing high frequency current to the lamp-load with use of primary series-resonant LC circuit having substantially inductive character of its impedance which is automatically and naturally changing to be more or less inductive—in proportion to the magnitude of the rectified AC line voltage.

A further object of the present invention is that of providing an integrated into a single stage electronic energy converter wherein, the energy used to correct the power factor is not redirected from the output to the input of the device, and is rather stored within and released by the auxiliary resonant capacitor Ca of the auxiliary series-resonant LaCa circuit comprised of the equivalent inductance La of the inductive impedance of the primary series-resonant LC circuit used to operate the lamp-load.

Yet another object of the present invention is that of providing an integrated into a single stage electronic energy converter which can operate the gas discharge lamp properly in dimming mode accomplished with use an ordinary incandescent dimmer.

In accordance with the invention there is provided an energy conversion device having a DC pulsating voltage at DC input terminals and adapted to deliver a high frequency signal to a load, the device comprising:

rectifier means receiving a source voltage from an AC power source and providing at first DC output terminals a first pulsating DC voltage;

a rectifier circuit having unidirectional devices connected to form AC input terminals and a pair of input terminals which form positive and negative DC terminals, respectively, and the rectifier circuit having each of the unidirectional devices exhibiting a switching action characterized by an ON-time period when conducting electrical current, and characterized by OFF-time period when not conducting electrical current;

an auxiliary resonant capacitor operable to provide between said DC terminals a variable DC voltage having an absolute instantaneous peak magnitude higher then absolute instantaneous peak magnitude of a rectified voltage of the alternating voltage source;

an energy-storage capacitor having DC input terminals and connected with a diode in a series circuit which is connected between the DC terminals, the diode having its anode electrode connected to the positive DC terminal, and the diode being operative, in conjunction with the energy-storage capacitor, to develop between the input terminals a DC input voltage separated from the variable DC voltage, and the energy-storage capacitor being operative to receive the energy from the auxiliary resonant capacitor during the OFF-time period and whenever the instantaneous peak magnitude of the variable DC voltage is higher than an instantaneous peak magnitude of the DC input voltage;

semiconductor switching means coupled to the energy storage capacitor and having two alternately conducting transistors connected to form a common junction therebetween; and a primary resonant oscillator circuit coupled to the DC terminals and to the common junction of the switching transistor inverter, and being operable to draw from the DC terminals a pulsating current conducted by the unidirectional devices and the diode means and comprising: (i) a primary resonant capacitor and a primary resonant inductor adapted to have a gas discharge load driven thereby, and (ii) an oscillation control circuit operable to deliver to the alternately conducting transistors a oscillation control signal to cause the resonant oscillator circuit to oscillate with frequency which is automatically maintained in proportion to an instantaneous amplitude of a voltage equal to a difference of instantaneous amplitude of the constant DC voltage and instantaneous amplitude of the voltage supplied by the rectified low frequency alternating voltage source;

wherein the primary resonant circuit having frequency dependent impedance being substantially inductive in its character and exhibits an auxiliary inductance which interacts with the auxiliary resonant capacitance means to store and release energy during the ON-time and OFF-time periods proportional to a time period of half-cycle associated with the frequency of oscillation of the primary resonant oscillator means; the auxiliary resonant capacitance means and auxiliary resonant inductance are operable to resonantly interact and have a resonant frequency near or equal to the frequency of oscillation of the primary resonant oscillator means; each of the alternately conducting transistors having a duty cycle associated with the conduction and said duty cycle is automatically modulated in proportion to the instantaneous amplitude of a voltage equal to the difference of instantaneous amplitude of the constant DC voltage and instantaneous amplitude of the voltage supplied by the rectified low frequency alternating voltage source; the frequency of oscillation of the primary resonant oscillator means is considerably faster that half-cycle frequency of the alternating voltage source;

whereby an instantaneous magnitude of a current drawn from the alternating voltage source is substantially proportional to an instantaneous magnitude of the voltage of the alternating voltage source.

A further feature of the invention is provided in which the resonant oscillator comprising: (i) a primary inductor and a primary capacitor connected in series and being adapted to power the gas discharge load effectively connected in parallel with the primary capacitor, and (ii) a switching feedback transformer being responsive to an instantaneous magnitude of the pulsating current and operable to deliver to the alternately conducting transistors a switching signal proportional to the instantaneous magnitude of the pulsating current, and cause the primary resonant oscillator circuit to oscillate with a frequency which is automatically modulated to be in proportion to the instantaneous amplitude of a voltage equal to the difference of instantaneous amplitude of the constant DC voltage and instantaneous amplitude of the voltage supplied by the rectified low frequency alternating voltage source.

A further feature of the invention is provided in which the primary resonant circuit being operable to draw from the DC terminals a pulsating current conducted by the unidirectional devices, and to develop a pulsating voltage at its output terminals, and the primary resonant circuit comprising: (i) a primary inductor and a primary capacitor connected in series and being adapted to power the gas discharge load effectively connected in parallel with the primary capacitor, and (ii) a switching feedback windings magnetically coupled to the primary resonant inductor and operable to deliver to the alternately conducting transistors a switching signal to cause the primary resonant circuit to oscillate with a frequency which is automatically modulated in proportion to the instantaneous amplitude of a voltage equal to the difference of instantaneous amplitude of the constant DC voltage and instantaneous amplitude of the voltage supplied by the rectified low frequency alternating voltage source.

Another feature of the present invention is provided in which in response to a control action delivered to a control input means, a decrease of effective magnitude of the AC voltage causes a power magnitude delivered to the filaments of the gas discharge load to increase proportionally.

In accordance with the present invention, the rectifier circuit can be either in the form of a full-wave rectifier bridge circuit or a dubler circuit.

In accordance with the present invention the auxiliary resonant capacitance comprising one or more capacitors connected in parallel with selected one or more unidirectional devices of the rectifier means.

The device further comprising the capacitor means as polarized electrolytic capacitor.

The device further comprising the semiconductor switching means as a pair of npn bipolar transistors connected in a half-bridge configuration for alternating operation.

The device further comprising the resonant oscillator means having the switching feedback loop equipped with a transformer made with a toroidal ferrite ore equipped with three separate windings of 1 to 6 turns each.

The device further comprising the resonant oscillator means which has the switching feedback loop equipped with a control circuit.

In such a device the instantaneous magnitude of input current is proportional to the instantaneous magnitude of the power line voltage, and the total harmonic distortion of the current is below 20%. In result, power is drawn from the power line with power factor of 99% lamp current crest factor is below 1.7.

Other objects and advantages of the present invention shall be made clear in following description of the invention detailed with reference to various embodiments of the invention as shown in accompanying drawings.

DESCRIPTION OF THE PREFERRED EMBODIMENTS

Figure 1:
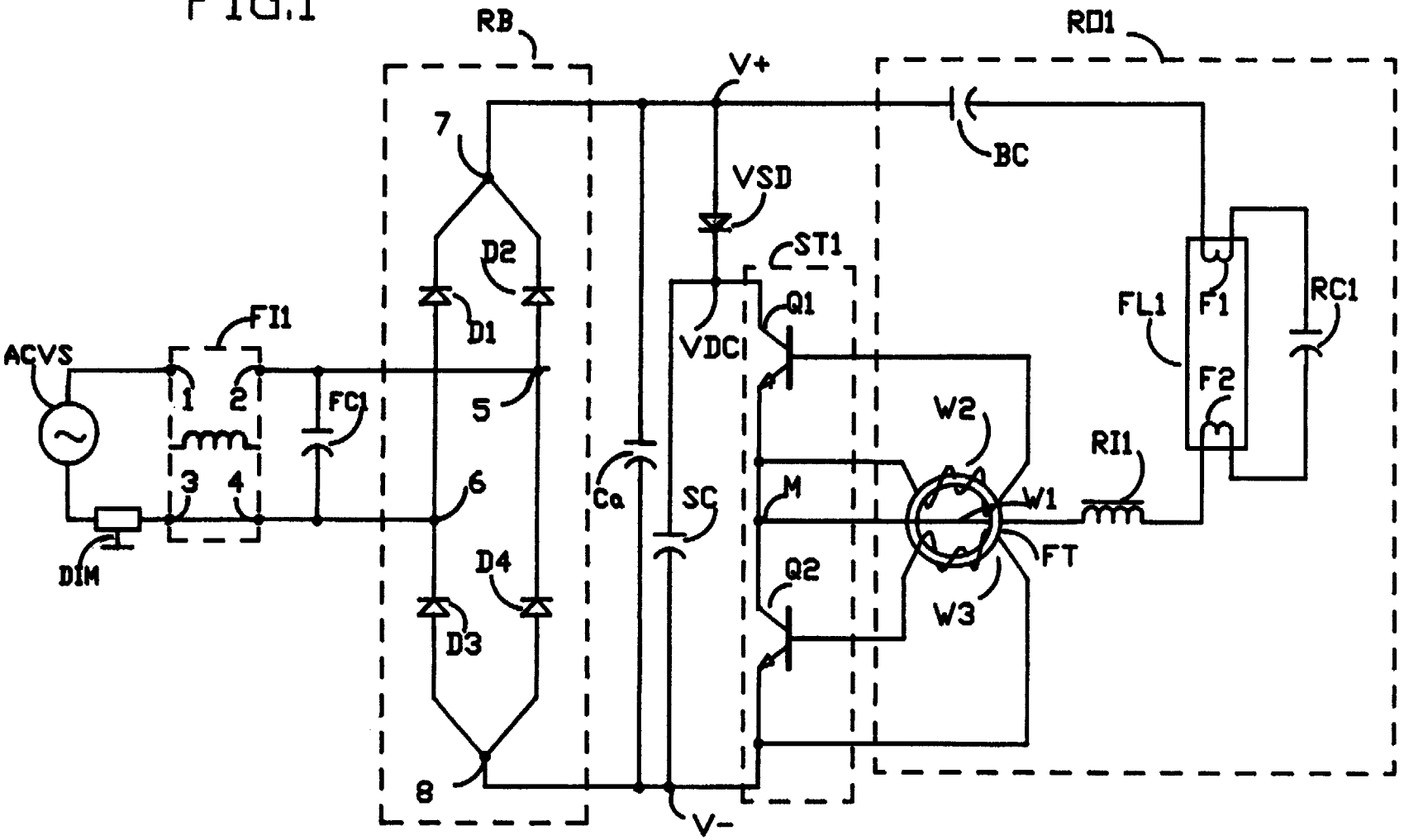
FIG. 1 schematically illustrates the invention in its first embodiment.

FIG. 1 schematically illustrates the main preferred embodiment of the invention in the form of an electrical circuit diagram.

In FIG. 1 a voltage source ACVS represents an ordinary 120 Volt/60 Hz electric utility power line and is connected through a dimmer unit DIM and via four terminals (1,2,3,4) filter inductor FI1 to AC input terminals 5 and 6 of a full wave rectifier bridge RB. A filter capacitor FC1 is connected between the terminals 5 and 6. The bridge RB is made of four rectifier diodes and has a pair of DC output terminals 7,8 where the terminal 7 is a positive one and the terminal 8 is a negative one. The terminal 7 of the bridge RB is connected to a first DC input terminal V+, and the terminal 8 is connected to a second DC input terminal V−.

A voltage separating diode VSD is connected with its anode electrode to the terminal V+ and with its cathode electrode to an intermediate node VDC. A storage capacitor SC is connected between the node VDC and the terminal V−.

A half-bridge switching transistor inverter ST1 has a bipolar transistor Q1 (of the type MJE 13005) connected at its collector electrode to the intermediate node VDC. The transistor 105 has its emitter electrode connected to a node M. A further npn transistor Q2 (like the transistor Q1, of the type MJE 13005) of the inverter has its collector electrode connected to the node M. The transistor 107 has its emitter electrode connected to the terminal V−.

A resonant oscillator circuit RO1 has a DC blocking capacitor BC (having value of approximately 0.1 uF), and a primary series resonant circuit consisting of a primary resonant capacitor RC1 (having value of approximately 18 nF), and a primary resonant inductor RI1 (having value of approximately 1 mH), and a primary winding W1 of a feedback transformer FT, all connected in series between terminal V+ and the node M, via filaments F1,F2 of a gas discharge lamp FL1. Thereby, the gas discharge lamp (of the type Dulux E 26W by Osram) is effectively connected across the primary resonant capacitor RC1. The feedback transformer FT is equipped with two secondary windings W2,W3 connected across base-emitter junctions of the switching transistors Q1,Q2, respectively. This device can be made operational with either saturable core or non-saturable core used in design of the feedback transformer. The saturable core used is made by Magnetics, Inc. of Butler, Pa., model nr OW40603-TC. The non-saturable core feedback transformer may be designed with core made by Magnetics, Inc., model nr J-42510-EC.

Figure 2:
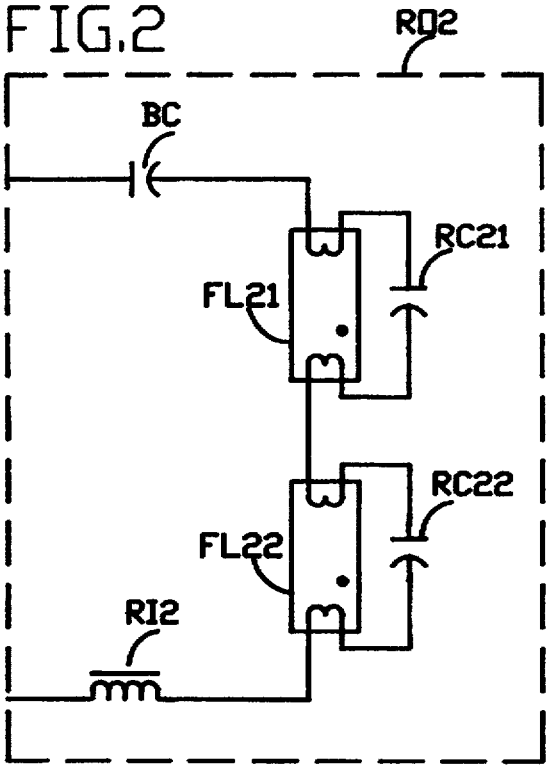
FIG. 2, FIG. 3, FIG. 4(*a*) and FIG. 4(*b*) show fragmentary illustrations of the alternative versions of the embodiments of FIG. 1, FIG. 5, FIG. 6, FIG. 7, and FIG. 11.

FIG. 2 illustrates a fragment of a resonant oscillator RO2 as an alternative version of the resonant oscillator RO1. Two gas discharge lamps FL21, FL22 are connected in series. The lamps FL21, FL22 have resonant capacitors RC21, RC22 connected in parallel, respectively.

Figure 3:
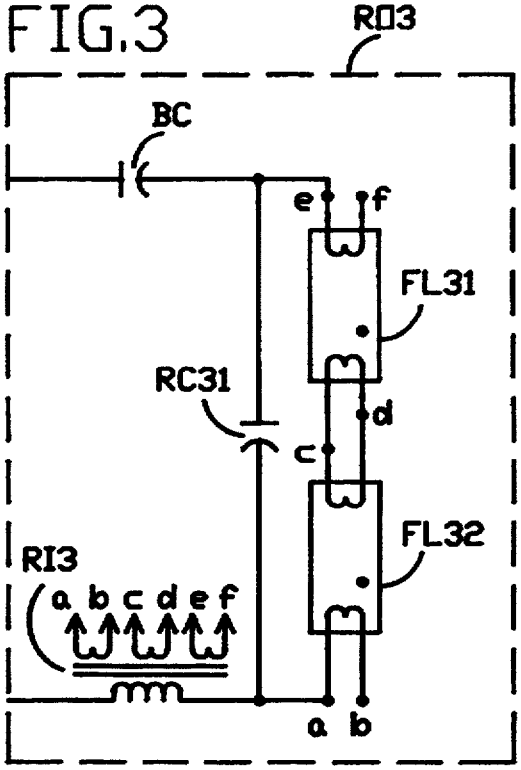

FIG. 3 illustrates a fragment of a resonant oscillator RO3 as another alternative version of the resonant oscillator RO1. Two gas discharge lamps FL31, FL32 are connected in series and have one resonant capacitor RC31 connected thereby. The filaments of the gas discharge lamps are powered by secondary windings of a resonant inductor RI3.

Figure 4A:
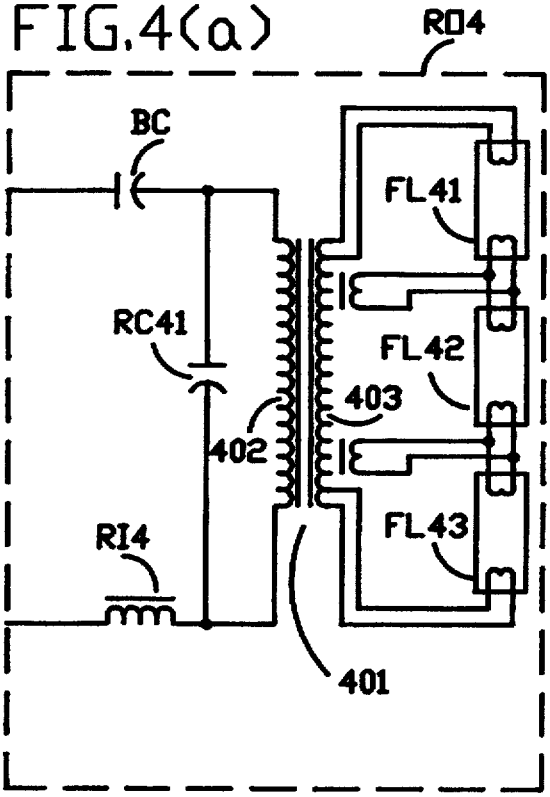
Figure 4B:
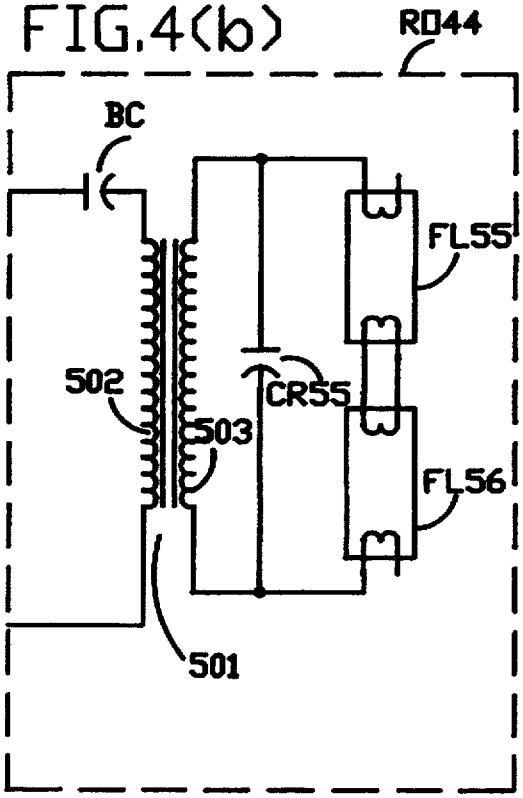

FIG. 4(*a*) illustrates a fragment of a resonant oscillator RO4 as another alternative version of the resonant oscillator RO1. An isolation transformer 401 is connected at its primary winding 402 across a resonant capacitor RC41. The secondary winding 403 of the transformer 401 is used to power three fluorescent lamps FL41, FL42, FL43 connected in series.

FIG. 4(*b*) illustrates a fragment of resonant oscillator RO44 as yet another alternative version of the resonant oscillator RO1. An isolation transformer 501 has a primary winding 502 and a secondary winding 503. The transformer is constructed in such a way that a leakage inductance exists in a magnetic coupling between the windings, and the leakage inductance serves a function of a resonant inductance, forming a resonant circuit with a capacitor CR55 and gas discharge lamps FL55,FL56.

Figure 5:
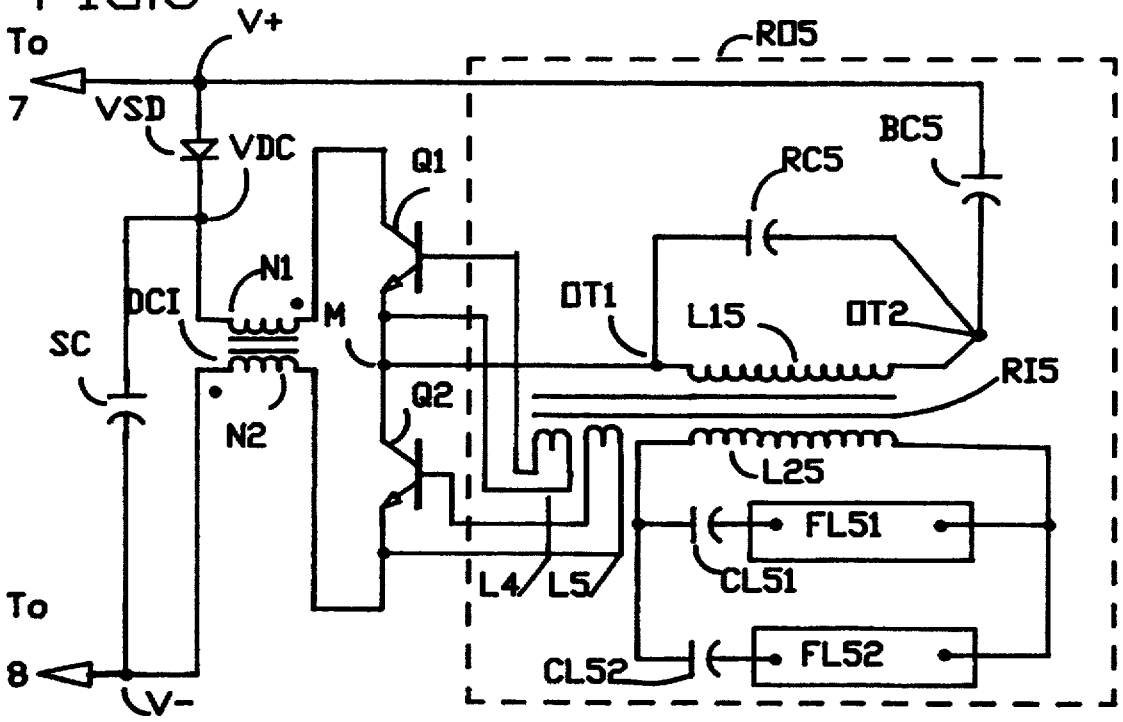
FIG. 5 schematically illustrates the invention in its second embodiment.

In FIG. 5 the transistor Q1 is connected at its collector electrode to the intermediate terminal VDC, via winding N1 of a DC inductor DC1. Further, the transistor Q2 is connected at its emitter electrode to the terminal V−, via winding N2 of the DC inductor DCI. A resonant oscillator RO5 has a resonant capacitor RC5 connected in parallel with a primary winding L15 of a resonant inductor RI5, forming a pair of output terminals OT1, OT2. A DC blocking capacitor BC5 is connected between terminal V+ and terminal OT2. The terminal OT2 is connected to the node M. Two gas discharge lamps FL51,FL52 are coupled to the output terminals, via a secondary winding L25 of the inductor RI5. Additional secondary windings L4,L5 of the resonant inductor RI5 are connected between base-emitter junctions of the transistors Q1, and Q2, respectively.

Figure 6:
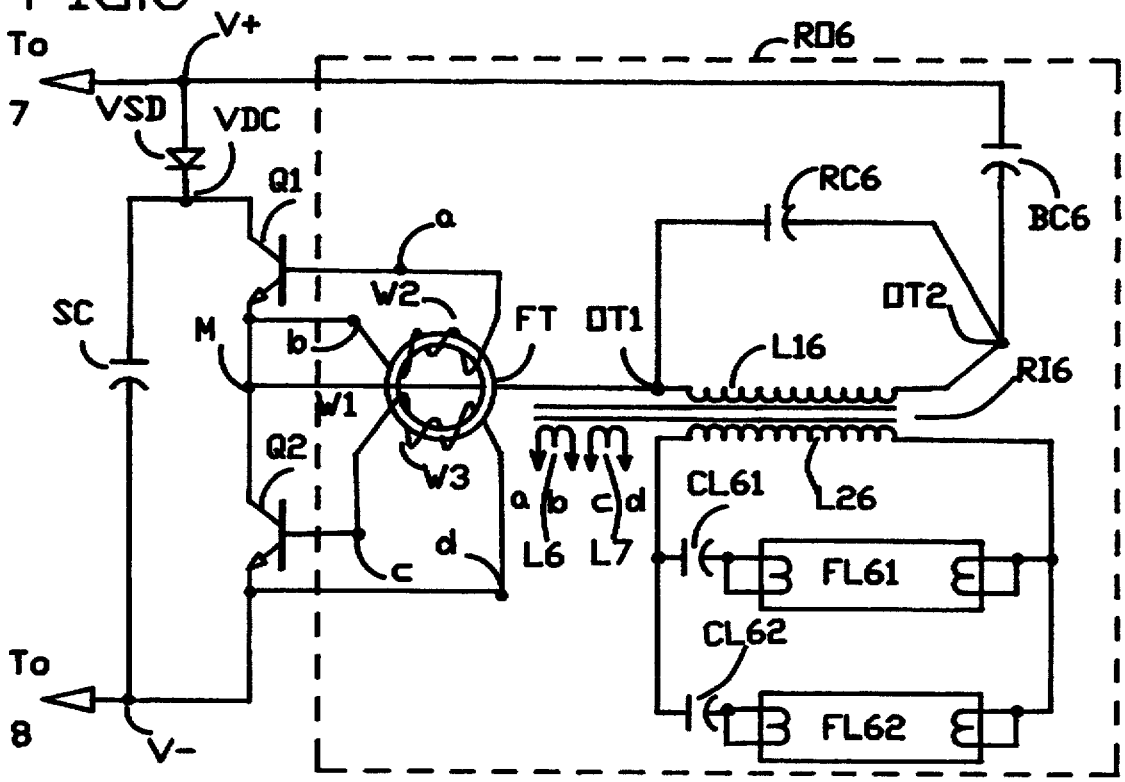
FIG. 6 shows an alternative version of the embodiments of FIG. 5, FIG. 1, FIG. 7, and FIG. 11.

In FIG. 6 a resonant capacitor RC6 is connected in parallel with a primary winding L16 of a resonant inductor RI6, forming a pair of output terminals OT1, OT2. A DC blocking capacitor DC6 is connected between terminal V+ and terminal OT2. The terminal OT1 is connected with the node M, via primary winding W1 of the feedback transformer FT. The secondary windings W2,W3 of the feedback transformer FT are connected between base-emitter junctions of the transistors Q1 and Q2, respectively. Further, secondary windings L6,L7 of the resonant inductor RI6 are also connected between base-emitter junctions of the transistors Q1 and Q2, respectively.

Figure 7:
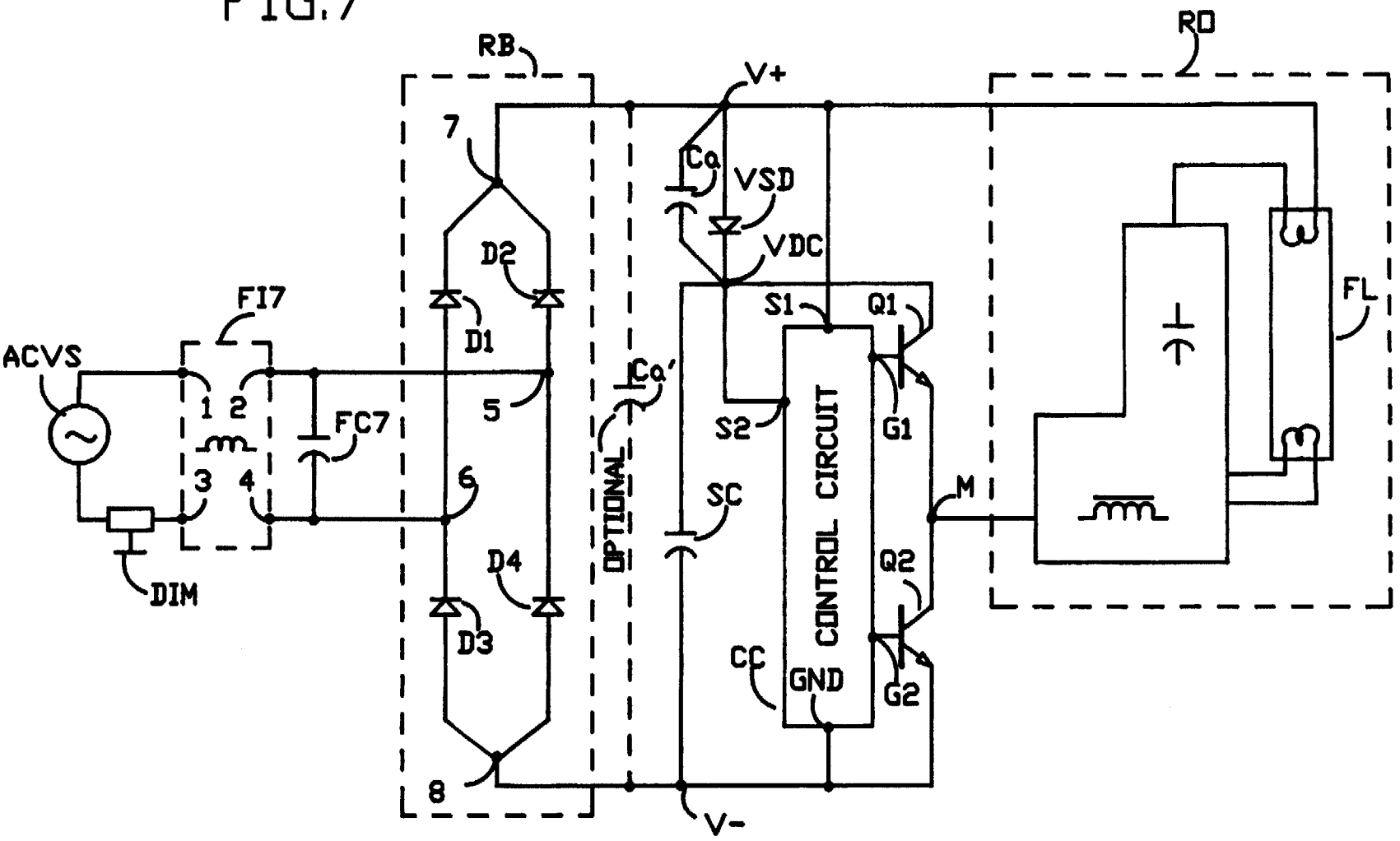
FIG. 7 illustrates the invention in its third embodiment.

In FIG. 7 a control circuit CC is used to provide a switching signal to the bases of the transistors Q1 and Q2. The control circuit is connected with its sensing pin S1 to the terminal V+, and with its sensing pin S2 to the terminal VDC.

Figure 8:
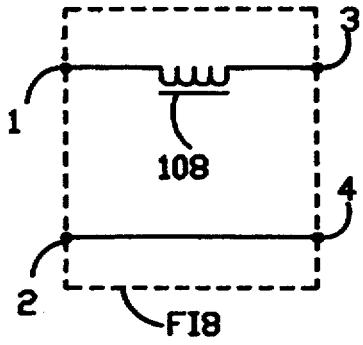
FIG. 8, FIG. 9, FIG. 10, and FIG. 12 show fragmentary illustrations of the alternative versions of the embodiments of FIG. 1, FIG. 7, and FIG. 11.
Figure 9:
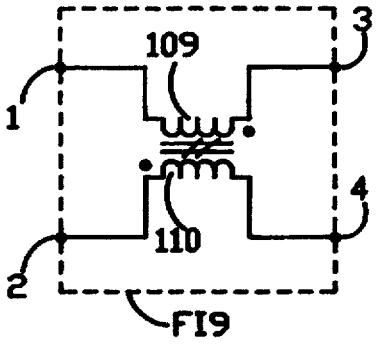
Figure 10:
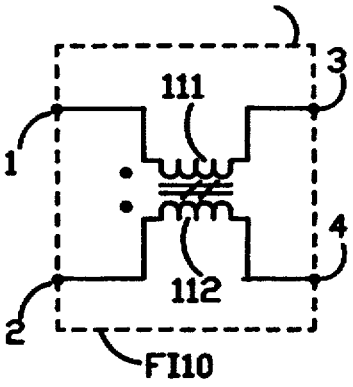

Referring now to FIG. 8, FIG. 9, and FIG. 10 which are illustrating alternative versions of the filter inductor FI1. A filter inductor FI8 is a simple inductor connected between terminals 1 and 3. A filter inductor FI9 is a differential type inductor having two windings 109 an 110. A filter inductor FI10 is a common mode type inductor having two windings 111 and 112.

Figure 11:
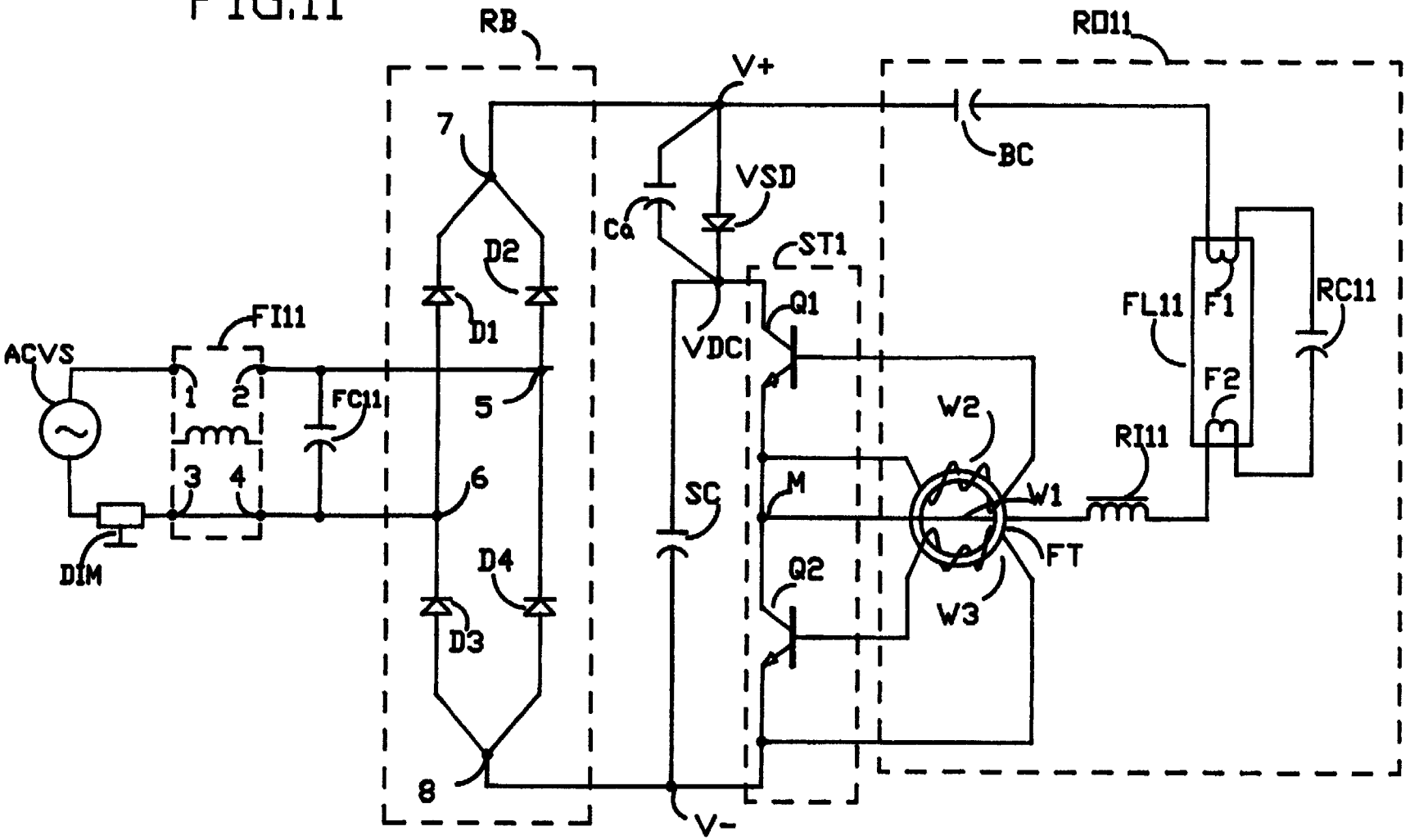
FIG. 11 illustrates the invention in its fourth embodiment.
Figure 13A:
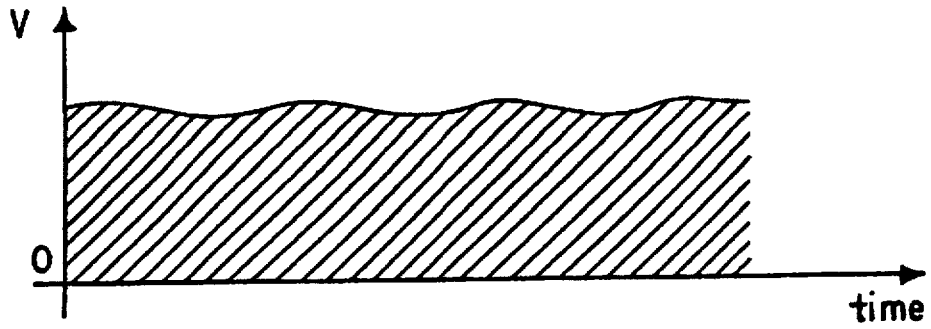
FIG. 13(*a,b,c,d*), shows various current and voltage waveforms associated with operation of the device of the present invention.
Figure 13B:
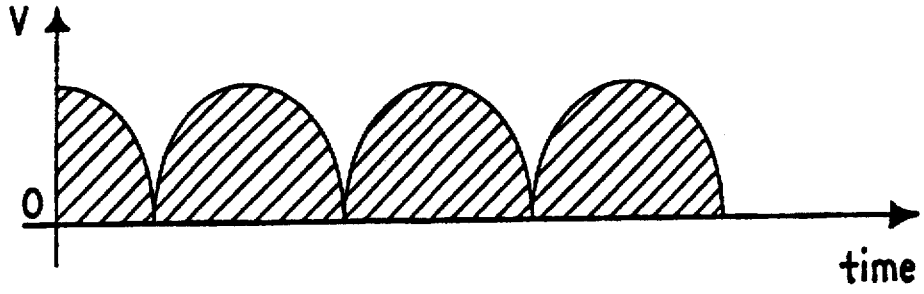
Figure 13C:
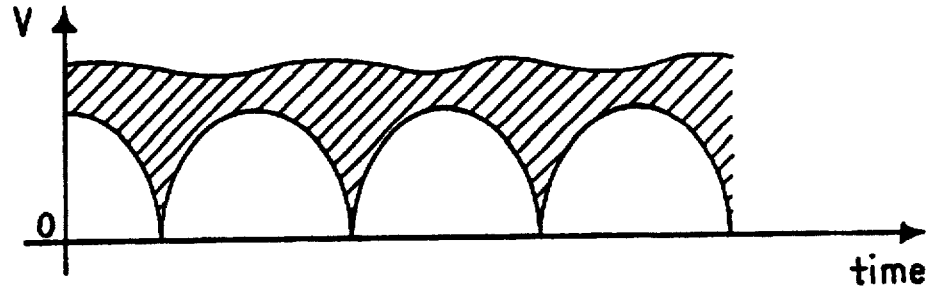
Figure 13D:
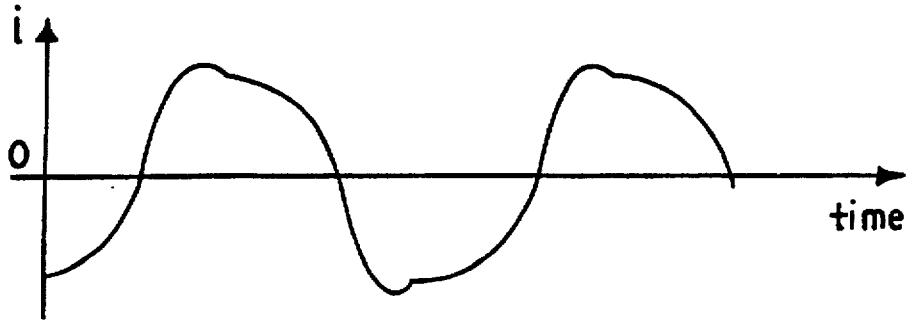

In FIG. 11 which is alternative version of the embodiment of FIG. 1, the auxiliary resonant capacitor Ca is connected instead across the voltage separating diode VSD.

Figure 12:
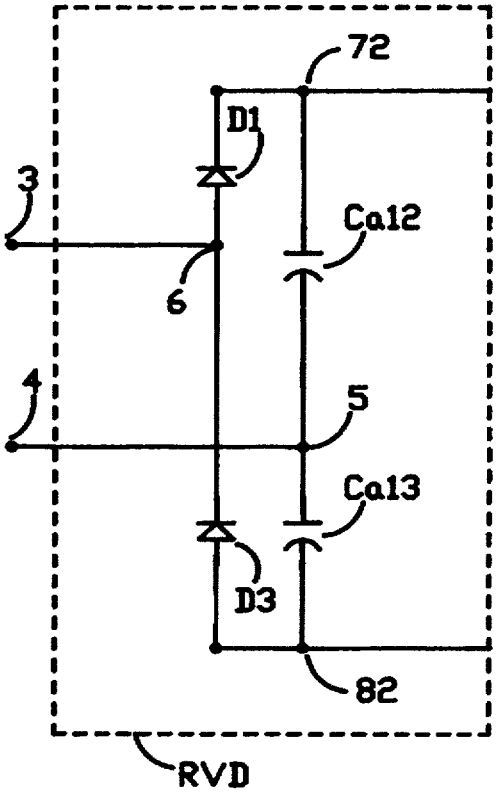

A rectifying voltage doubler RVD of FIG. 12, may be substituted for the rectifying bridge RB of FIG. 1.

In FIG. 1, the alternating voltage source ACVS represents an ordinary electric utility power line (120V AC, 60 Hz) which is connected through the dimmer unit DIM and the filter inductor FI1 to the rectifying bridge RB. When the rectified voltage is present between terminals V+ and V−, the energy storage capacitor SC is being charged in a relatively rapid manner up to the peak magnitude of the alternating voltage of the voltage source ACVS.

The device starts its oscillations by triggering provided with a commonly known diac circuit (not shown). For better understanding of the operation of the device, let assume that the alternating voltage, as per FIG. 13(*a*), is at the beginning of the positive half-cycle when the transistor Q2 is switched into its conduction state. At that time, the resonant oscillator RO1 is effectively connected between terminals V+ and V−. The resonant oscillator RO1 draws a pulsating current from these terminals, and the current is also circulated through the diodes of the rectifying bridge RB and via the voltage separating diode VSD. Diodes D2 and D3 of the bridge RB are conducting current to supply energy to the energy storage capacitor SC, and to the resonant oscillator RO1, and to the lamp-load FL1, and to charge the auxiliary resonant capacitor Ca. Diodes D1 and D4 of the bridge RB are not conducting continuous current supplied by the power line when the voltage of that line is positive. Therefore, the auxiliary resonant capacitor connected to terminals V+ and V−, is charged up to that voltage magnitude which is present at that time. The pulsating current ends its pulse after a predetermined time period associated with the frequency of the resonant oscillator RO1. Then, the transistor Q1 is switched into its conduction (ON) state, and transistor Q2 is switched into its open (OFF) state. Due to a fact, that the resonant oscillatory circuit RO1 is oscillating with a predetermined frequency of oscillation (fo), preset at such that its instantaneous equivalent impedance (Zin) has always inductive character and is described per the following formula:

$$Zin = \left[ RL + \frac{\omega^2 RC^2}{R^2 + \omega^2 C^2} \right] + j\omega \left[ L - \frac{R^2 C}{R^2 + \omega^2 C^2} \right]$$

where:

R=resistance of the lamp-load;

C=capacitance of the primary resonant capacitor RC1;

L=inductance of the primary resonant inductor RI1;

RL=resistance representing losses of the primary resonant inductor RI1; and $\omega = 2\pi fo$;

Therefore, the auxiliary resonant inductance La is represented by the following formula:

$$La = L - \frac{R^2 C}{R^2 + \omega^2 C^2}$$

The auxiliary resonant inductance La and the auxiliary resonant capacitance Ca forming here the auxiliary series resonant circuit. The energy of this circuit is naturally stored and released in the periodical manner, and is provided as an auxiliary voltage across the capacitor Ca, having an instantaneous magnitude higher than the rectified voltage provided by the power line at the time. As a result, a variable DC voltage is developed between DC input terminals V+, V−, as per FIG. 13(*c*). The energy storage capacitor SC is charged-up to a voltage magnitude which is a result of natural integration of the variable DC voltage magnitude and rectified power line voltage magnitude at that time. The frequency of the resonant oscillator is approximately 35 kHz. Therefore, during the positive half-cycle of the voltage supplied by the power line, the diodes D2 and D3 will be conducting pulsed current approximately 291 times.

When the power line voltage is near its peak, the auxiliary voltage, when added to the power line voltage, would normally cause a very high instantaneous voltage between the DC input terminals V+ and V− to be present, if not for a switching feedback arrangement instant response. The resonant oscillator having the feedback transformer responsive to the instantaneous magnitude of the pulsating current, adjusts its frequency in such a way, that the auxiliary voltage is instantly adjusted to effect the magnitude of the variable DC voltage to be instantly lowered, as shown in FIG. 13(*c*). The transistors' duty cycle is also instantly adjusted. The complete circuit is naturally and automatically synchronized and self-controlled.

Such a variable and complex load arrangement which is changing in very dynamic way, effects modulation of the gain factors of the primary and secondary resonant circuits, accordingly. Therefore, the impedance character (less or more inductive) of the entire resonant oscillator is changing also in proportion to the changes mentioned above. However, despite such modulations, the magnitude of the pulsating current which flows through the resonant inductor RO1, and magnitude of the load current are being kept relatively constant due to instantaneous self-adjustment of the switching frequency of the resonant oscillator by the feedback transformer FT, so the impedance effective value associated with the first series resonant circuit is being kept relatively constant only the character of that impedance is changing dynamically.

The resonant frequency associated with the resonant oscillator is also chosen to satisfy a fundamental reliability rule of this type of device: impedance of the resonant circuit shall be always inductive, despite of variations of the load magnitude or power line voltage magnitude, as would be during the dimming process with use of the ordinary dimmer DIM.

The voltage magnitude across the auxiliary resonant capacitor Ca is equal to a difference of instantaneous magnitude of the variable DC voltage developed across terminals V+,V− and instantaneous magnitude of rectified, not filtered voltage between terminals 7 and 8, the later being provided by rectified voltage source and is shown in FIG. 13(*b*).

The absolute peak magnitude of the DC input voltage is equal or higher than peak magnitude of the rectified AC voltage source. The parameters of determining the magnitude of that voltage, as per FIG. 8(*a*), are: instantaneous and effective load value and Q-factors of the primary and secondary series resonant circuits. The above parameters are most important factors in obtaining stability and proper operation.

In order to produce high power factor a low THD, the auxiliary resonant circuit LaCa is tuned to the same or near the same frequency as the frequency of oscillations (fo) of the resonant oscillator circuit RO1 which includes the primary resonant circuit of the inductor RI1 and the capacitor RC1 having lamp load connected effectively in parallel.

As a secondary function, the voltage separating diode VSD permits charging the energy-storage capacitor SC, whenever the variable DC voltage magnitude rises above a voltage magnitude present at the time across the capacitor SC. Thereby, a constant DC voltage is developed across terminals of the capacitor SC, as in FIG. 13(*a*).

The alternately conducting transistors Q1, Q2 are operated by the feedback transformer FT to connect the resonant oscillator circuit RO1 alternately to the variable DC voltage developed between terminals V+, V− and to a voltage equal to a sum of instantaneous magnitudes of the constant DC voltage and the variable DC voltage. Thus, the constant DC voltage serves as an effective energy reserve, activated when is needed to provided a relatively constant power to the lamp load, over the entire cycle of the alternating voltage provided by the source ACVS.

Naturally, the energy-storage capacitor SC is being partially charged from the power line and partially from the energy storing auxiliary resonant capacitance Ca. In result the waveform of the current drawn from the sinusoidal power line become proportional to the voltage waveform of that line. Thereby, the initial charging current (inrush current) of the capacitor SC, drawn from the power line, is effectively reduced below 10 Amperes in peak magnitude. Also, at the steady mode of operation, the power factor of the entire device is near 0.99 and total harmonic distortion of the current drawn from the power line is less than 20 percent.

At the time, when the power line voltage is at its negative half-cycle, the diodes D1 and D4 are conducting the continuous line current, and the diodes D2 and D3 are conducting the pulsating current. The two pairs of diodes reverse their functions, when the power line voltage reverses from positive to negative and vice-versa. All other functions of the device components are the same as in the positive half-cycle of the power line voltage.

FIG. 5, attached hereto, represents the device in its second embodiment. The circuit shown here is identical in operation to the one of FIG. 1, with the exception that the resonant elements are connected herein parallel. The switching feedback is accomplished with use of secondary windings L4,L5 operable to provide switching signal proportional to the pulsating voltage which is developed across both resonant elements.

Device of FIG. 6, is the alternative version of devices of FIG. 1 and FIG. 5, wherein the switching signal provided to the switching transistors Q1,Q2 is a combination of: (i) signal proportional to the resonant voltage and provided by windings L6 and L7, and (ii) signal proportional to the pulsating current provided by the feedback transformer. Otherwise, the circuit of FIG. 6 is identical in operation to the circuit of FIG. 1.

Referring now to FIG. 7, in the circuit of the third embodiment of the device, the switching feedback arrangement is substituted by a switching control circuit CC. The frequency of switching is dynamically controlled in proportion to signals delivered to the control circuit via the sensing pins S1 and S2, and said frequency is proportional to the difference of the variable DC voltage amplitude developed between terminals V+ and V−, and the constant voltage amplitude developed across the storage capacitor SC. The auxiliary capacitor Ca is connected across the voltage separating diode VSD which is performing a switching function here as well. Otherwise the device operates identically to the device of FIG. 1.

FIG. 11, attached hereto, represents the device in its second embodiment. The circuit shown here is identical in construction to the one shown in FIG. 1, with the exception that the auxiliary resonant capacitor Ca is connected here across the voltage separating diode VSD. In this arrangement the diode VSD conducts the pulsating current and performs the switching action ON and OFF with the frequency equal to the frequency of oscillations of the oscillatory resonant circuit RO1. Otherwise, the device operates identically to the device of FIG. 1.

Referring to operation of the device of the present invention during dimming: While the sinusoidal voltage waveform of the voltage supplied by the power live source ACVS, is controlled with an ordinary phase control dimmer, the voltage waveform supplied to the terminals 5 and 6 is no longer sinusoidal. The circuit configuration, having voltage separating diode VSD in series with energy-storage capacitor SC, provides for a relatively constant magnitude DC voltage to be present across the storage capacitor SC, despite phase control of the power line voltage. The phase control of the power live voltage results in providing lowered effective (RMS) magnitude of the voltage supplied to the terminals 5 and 6 of the bridge BR. Further, as required by the fluorescent lamp, the device of present invention provides for automatic and proportional increase of the voltage across the filaments F1 and F2 during the phase control regulation of the power line voltage by the dimmer DIM. Additionally, during phase control dimming, the frequency of oscillations of the oscillatory resonant circuit RO1 is automatically lowering itself for at least a portion of each half-cycle time period of the power line voltage waveform. Also, during the phase control dimming, the duty cycle of the switching transistors Q1, Q2 is automatically decreased for at least a portion of each half-cycle time period of the power line voltage waveform.

It will thus be appreciated that the described ballast circuit provided for a relatively simple, cost effective, highly reliable and highly efficient electronic ballast, which can be easily constructed to all varieties of gas discharge lamps and power level requirements.

It will be further appreciated that the described ballast circuit provides an improved single stage inverter having auxiliary resonant circuit comprised of auxiliary resonant capacitor and auxiliary resonant inductor as the equivalent inductance of the equivalent impedance of the primary series resonant circuit comprising primary resonant inductor and primary resonant capacitor having lamp load connected effectively in parallel.

It will be further appreciated that the described ballast circuit provides an improved circuit in which the energy is stored and released by the auxiliary resonant circuit for the purpose of correcting the power factor and providing for relatively constant power to be delivered to the lamp-load over the entire cycle of the power live voltage waveform.

It will be further appreciated that the described ballast circuit provides unique and novel arrangement having a primary, highly inductive in its impedance character, series resonant oscillating circuit adapted to connect and energize the lamp-load, and the auxiliary series resonant circuit for the purpose described above, wherein both resonant circuit being naturally and automatically synchronized and arranged to dynamically interact.

It will be further appreciated that the described ballast circuit provides a single stage integrated electronic energy converter, wherein the energy to correct the power factor in not redirected from the output to the input, and is rather stored within and released by the auxiliary resonant capacitor, at the input of the device.

It will be further appreciated that the device as described herein, operate in a manner that the waveform of the current drawn from the alternating voltage source is substantially proportional to the waveform of the voltage of said source, and the power is drawn from the power source with power factor of 99%, and current delivered to the device from the source is having total harmonic distortion below 20%. circuit is being kept relatively constant only the character of that impedance is changing dynamically.

It will be appreciated that due to implementation of the auxiliary resonant circuit integrated with the primary resonant circuit which operates the load, according to the present invention, the modulation of the character of frequency dependent impedance of these circuits in proportion to the modulation of instantaneous magnitude of the voltage equal to a difference between instantaneous magnitude of the variable DC voltage and instantaneous magnitude of the rectified AC voltage source is developed. Accordingly, it will be appreciated that due to implementation of the auxiliary resonant circuit integrated with the primary resonant circuit which operates the load, the frequency of oscillation of the resonant oscillator made with said circuits is modulated in proportion to the modulation of instantaneous magnitude of the voltage equal to a difference between instantaneous magnitude of the DC input voltage and instantaneous magnitude of the rectified AC voltage source.

It will thus be appreciated that the devices, as described herein will provide for substantial stability of its critical parameters (input power, power factor, total harmonic distortion, load current crest factor) despite: large variations of nominal AC voltage source, b) application of other than nominal load type, c) subjecting the devices to low and high temperatures.

It will be appreciated that device as described herein, will be very simple—with very low parts count, easily adaptable to all power line voltages and load types, repeatable in manufacturing process, and inexpensive.

It is believed by this applicant that the present invention and its several advantages and features will be understood from the foregoing description. However, it will be apparent to a person skilled in the art that without departing from the spirit of the invention, changes may be made in its form and in the construction and interrelationships of its component parts, the forms herein presented merely representing preferred embodiments.

I claim:

1. An electronic energy converter to supply a high frequency signal to a load and adapted to operate from a low frequency alternating voltage source, the device comprising:

rectifier means having unidirectional devices connected to form AC input terminals, and a positive DC terminal, and a negative DC terminal, and the unidirectional devices exhibit a switching action characterized by an ON-time period when conducting electrical current, and characterized by OFF-time period when not conducting electrical current;

auxiliary resonant capacitance means operable to provide between the DC terminals a variable DC voltage having absolute peak magnitude higher than or equal to absolute peak magnitude of the rectified voltage of the low frequency voltage source;

energy-storage means having DC input terminals and connected with a diode means in a series circuit which is connected between the DC terminals, the diode means having its anode electrode connected to the positive DC terminal, and the diode means being operative, in conjunction with the energy-storage means, to develop between the DC input terminals a constant DC voltage separated from the variable DC voltage, and the energy-storage means being operative to receive the energy from the auxiliary resonant capacitance means during the OFF-time period and whenever an instantaneous magnitude of the variable DC voltage is higher than an instantaneous magnitude of the constant DC voltage;

semiconductor switching means coupled to the energy-storage means and having two alternately conduction transistors connected to form a common junction therebetween; and primary resonant oscillator means coupled to the positive DC terminal and to the common junction of the semiconductor switching means, the resonant oscillator means operating to draw from the DC terminals a pulsating current conducted by the unidirectional devices and the diode means, and the primary resonant oscillator comprising: (i) a primary resonant inductor and a primary resonant capacitor connected in series and being adapted to power the load effectively connected in parallel with said capacitor, and (ii) a feedback transformer being responsive to an instantaneous magnitude of the pulsating current and operable to deliver to the semiconductor switching means a switching signal proportional to the instantaneous magnitude of the pulsating current, and to cause the resonant oscillator means to oscillate with a frequency automatically maintained in proportion to an instantaneous amplitude of a voltage equal to a difference of instantaneous amplitude of the constant DC voltage and instantaneous amplitude of the voltage supplied by the rectified low frequency alternating voltage source;

wherein the primary resonant circuit having frequency dependent impedance being substantially inductive in its character and exhibits an auxiliary inductance which interacts with the auxiliary resonant capacitance means to store and release energy during the ON-time and OFF-time periods proportional to a time period of half-cycle associated with the frequency of oscillation of the primary resonant oscillator means; the auxiliary resonant capacitance means and auxiliary resonant inductance are operable to resonantly interact and have a resonant frequency near or equal to the frequency of oscillation of the primary resonant oscillator means; each of the alternately conducting transistors having a duty cycle associated with the conduction and said duty cycle is automatically modulated in proportion to the instantaneous amplitude of a voltage equal to the difference of instantaneous amplitude of the constant DC voltage and instantaneous amplitude of the voltage supplied by the rectified low frequency alternating voltage source; the frequency of oscillation of the primary resonant oscillator means is considerably faster that half-cycle frequency of the alternating voltage source;

whereby an instantaneous magnitude of a current drawn from the alternating voltage source is substantially proportional to an instantaneous magnitude of the voltage of the alternating voltage source.

2. An electronic energy converter to supply a high frequency signal to a load and adapted to operate from a low frequency alternating voltage source, the device comprising:

rectifier means having unidirectional devices connected to form AC input terminals, and a positive DC terminal, and a negative DC terminal, and the unidirectional devices exhibit a switching action characterized by an ON-time period when conducting electrical current, and characterized by OFF-time period when not conducting electrical current;

auxiliary resonant capacitance means operable to provide between the DC terminals a variable DC voltage having absolute peak magnitude higher than or equal to absolute peak magnitude of the rectified voltage of the low frequency voltage source;

energy-storage means having DC input terminals and connected with a diode means in a series circuit which is connected between the DC terminals, the diode means having its anode electrode connected to the positive DC terminal, and the diode means being operative, in conjunction with the energy-storage means, to develop between the DC input terminals a constant DC voltage separated from the variable DC voltage, and the energy-storage means being operative to receive the energy from the auxiliary resonant capacitance means during the OFF-time period and whenever an instantaneous magnitude of the variable DC voltage is higher than an instantaneous magnitude of the constant DC voltage;

semiconductor switching means coupled to the energy-storage means and having two alternately conduction transistors connected to form a common junction therebetween;

primary resonant oscillator means coupled to the positive DC terminal and to the common junction of the semiconductor switching means, the resonant oscillator means operating to draw from the DC terminals a pulsating current conducted by the unidirectional devices and the diode means, and to develop a pulsating voltage at its output terminals, and the resonant oscillator comprising: (i) a primary resonant inductor and a primary resonant capacitor adapted to power the load effectively connected in parallel therewith, and (ii) a switching feedback windings magnetically coupled to the resonant inductor and operable to deliver to the semiconductor switching means a switching signal proportional to the instantaneous magnitude of the pulsating voltage and operable to cause the primary resonant oscillator means to oscillate with a frequency automatically maintained in proportion to an instantaneous amplitude of a voltage equal to a difference of instantaneous amplitude of the constant DC voltage and instantaneous amplitude of the voltage supplied by the rectified low frequency alternating voltage source;

wherein the primary resonant circuit having frequency dependent impedance being substantially inductive in its character and exhibits an auxiliary inductance interacting with the auxiliary resonant capacitance means to store and release energy during the ON-time and OFF-time periods proportional to a time period of half-cycle associated with the frequency of oscillation of the primary resonant oscillator means; the auxiliary resonant capacitance means and auxiliary resonant inductance are operable to resonantly interact and have a resonant frequency near or equal to the frequency of oscillation of the primary resonant oscillator means; each of the alternately conducting transistors having a duty cycle associated with the conduction and said duty cycle is automatically modulated in proportion to the instantaneous amplitude of a voltage equal to the difference of instantaneous amplitude of the constant DC voltage and instantaneous amplitude of the voltage supplied by the rectified low frequency alternating voltage source; the frequency of oscillation of the resonant oscillator means is considerably faster that half-cycle frequency of the alternating voltage source whereby an instantaneous magnitude of a current drawn from the alternating voltage source is substantially proportional to an instantaneous magnitude of the voltage of the alternating voltage source.

3. An electronic energy converter to supply a high frequency signal to a load and adapted to operate from a low frequency alternating voltage source, the device comprising:

rectifier means having unidirectional devices connected to form AC input terminals, and a positive DC terminal, and a negative DC terminal, and the unidirectional devices exhibit a switching action characterized by an ON-time period when conducting electrical current, and characterized by OFF-time period when not conducting electrical current;

auxiliary resonant capacitance means operable to provide between the DC terminals a variable DC voltage having absolute peak magnitude higher than or equal to absolute peak magnitude of the rectified voltage of the low frequency voltage source;

energy-storage means having DC input terminals and connected with a diode means in a series circuit which is connected between the DC terminals, the diode means having its anode electrode connected to the positive DC terminal, and the diode means being operative, in conjunction with the energy-storage means, to develop between the DC input terminals a constant DC voltage separated from the variable DC voltage, and the energy-storage means being operative to receive the energy from the auxiliary resonant capacitance means during the OFF-time period and whenever an instantaneous magnitude of the variable DC voltage is higher than an instantaneous magnitude of the constant DC voltage;

semiconductor switching means coupled to the energy-storage means and having two alternately conduction transistors connected to form a common junction therebetween;

primary resonant oscillator means coupled to the positive DC terminal and to the common junction of the semiconductor switching means, the resonant oscillator means operating to draw from the DC terminals a pulsating current conducted by the unidirectional devices and the diode means, and the resonant oscillator comprising: (i) a primary inductive element and a primary capacitive element being adapted to have the load driven thereby, and (ii) an oscillation control means operable to deliver to the semiconductor switching means an oscillation control signal to cause primary resonant oscillator means to oscillate with a frequency which is maintained in proportion to an instantaneous amplitude of a voltage equal to a difference of instantaneous amplitude of the constant DC voltage and instantaneous amplitude of the voltage supplied by the rectified low frequency alternating voltage source;

wherein the primary resonant circuit having frequency dependent impedance being substantially inductive in its character and exhibits an auxiliary inductance interacting with the auxiliary resonant capacitance means to store and release energy during the ON-time and OFF-time periods proportional to a time period of half-cycle associated with the frequency of oscillation of the primary resonant oscillator means; the auxiliary resonant capacitance means and auxiliary resonant inductance are operable to resonantly interact and have a resonant frequency near or equal to the frequency of oscillation of the primary resonant oscillator means; each of the alternately conducting transistors having a duty cycle associated with the conduction and said duty cycle is automatically modulated in proportion to the instantaneous amplitude of a voltage equal to the difference of instantaneous amplitude of the constant DC voltage and instantaneous amplitude of the voltage supplied by the rectified low frequency alternating voltage source; the frequency of oscillation of the resonant oscillator means is considerably faster that half-cycle frequency of the alternating voltage source whereby an instantaneous magnitude of a current drawn from the alternating voltage source is substantially proportional to an instantaneous magnitude of the voltage of the alternating voltage source.

4. The device according to claim 1, 2 or 3 wherein the rectifier means can be either in the form of a full-wave rectifier bridge circuit or a doubler circuit.

5. The device according to claim 1, 2 or 3, wherein the auxiliary resonant capacitance means is coupled across the diode means.

6. The device according to claim 1, 2 or 3, wherein the auxiliary resonant capacitance means is coupled to the DC terminals.

7. The device according to claim 1, 2 or 3, wherein the primary oscillator means having one or more gas discharge lamps effectively connected in parallel with the capacitor either in non-isolated or isolated configuration and be integrated into one magnetic structure.

8. The device according to claim 1 wherein the feedback transformer is made with a toroidal ferrite core equipped with three separate windings having 1 to 6 turns each.

9. Electronic device operating directly from the an alternating voltage source, having a rectifier circuit and a diode means coupled with a auxiliary resonant capacitor means operable to store and release energy in a periodical manner, and said device comprising:

a high frequency oscillator provided with switching means having a switching frequency and a switching duty cycle, said oscillator being equipped with a load circuit adapted to have a gas discharge load energized thereby, and the device being characterized by the fact, that the high frequency oscillator draws a pulsating current from the rectifier output in a periodical manner, causing the switching action of the rectifier circuit and of the diode means, and said oscillator having frequency dependent impedance of substantially inductive character and exhibits an auxiliary resonant inductance which interacts resonantly with the auxiliary resonant capacitance means operable to: (i) store and release energy in a time period proportional to a time of half-cycle of the switching frequency, and (ii) operate to develop at the rectifier output a variable DC voltage having absolute peak magnitude higher then absolute peak magnitude of a rectified voltage of the alternating voltage source;

wherein, the switching frequency and switching duty cycle being proportional to a modulated amplitude of a voltage equal to a difference of instantaneous magnitude of the variable DC voltage and instantaneous magnitude of the voltage supplied by rectified alternating voltage source, and the high frequency oscillator is naturally and automatically synchronized with the an auxiliary resonant circuit formed by the auxiliary resonant inductance and the auxiliary capacitance means, in such a way, that the switching action, as well as the periodical manner of energy storage and release, being determined by the switching frequency and the switching duty cycle of the switching means.

10. An electronic device for powering a gas discharge load from a low frequency power line source wherein the device draws a current substantially proportional to a voltage of the power line, the device comprising:

a primary resonant oscillator means having a switching transistor and adapted to energize the gas discharge load;

a rectifier means; and an auxiliary resonant circuit comprising: (i) auxiliary resonant capacitance coupled to the rectifier means, and (ii) auxiliary resonant inductance provided by and integrated with the primary resonant oscillator means.

11. An inverter device for a high frequency signal supply to a load, the device comprising:

a dimmer means having a control input means coupled to an AC voltage source and operable to provide a constant or variable effective magnitude of an AC output voltage from the AC voltage source;

rectifier means receiving at a DC input the AC output voltage and providing at a DC output a pulsating DC voltage source having a pulsating DC voltage of absolute peak magnitude higher than absolute peak magnitude of the rectified AC output voltage;

unidirectional device means coupled to the pulsating DC voltage source;

energy storage means receiving energy from the pulsating DC voltage source via the unidirectional device and providing at DC terminals a relatively constant DC voltage; inverter circuit means coupled to the energy storage means and comprising: (i) semiconductor switching means receiving the constant DC voltage and operable in a periodical ON and OFF manner; and (ii) resonant oscillator means coupled to the semiconductor switching means and providing, in proportion to a control action provided at the control input means, a constant or variable magnitude of a high frequency signal to the load.

12. A inverter device to supply a constant or variable magnitude of a high frequency signal to a load, the device operable from an AC voltage source equipped with a dimmer means having a control input means and operable to provide constant or variable effective magnitude of an AC output voltage at an AC output, the device comprising:

a primary resonant oscillator circuit means having a switching transistor operated by a control means and adapted to energize the gas discharge load;

a rectifier means coupled to the AC output; and an auxiliary resonant circuit comprising: (i) auxiliary resonant capacitance coupled to the rectifier means, and (ii) auxiliary resonant inductance provided by and integrated with the primary resonant oscillator circuit means.

13. A inverter device to supply a constant or variable magnitude of a high frequency signal to a gas discharge load equipped with filaments, the device being operable from a low frequency AC voltage source equipped with a dimmer means having a control input means and capable to provide constant or variable effective magnitude of an AC output voltage of continues or noncontinuous waveshape at an AC output, the device comprising:

a rectifier means having an output and being coupled to the AC output;

a high frequency oscillator provided with switching means operated by a control means and having a switching frequency and a switching duty cycle, said oscillator being equipped with a load circuit adapted to have the gas discharge load energized thereby, and the device being characterized by the fact, that the high frequency oscillator draws a pulsating current from the rectifier means in a periodical manner, causing the switching action of the rectifier means, and said oscillator having frequency dependent impedance of substantially inductive character and exhibits an auxiliary resonant inductance which interacts resonantly with the auxiliary resonant capacitance means operable to: (i) store and release energy in a time period proportional to a time of half-cycle of the switching frequency, and (ii) operate to develop at the rectifier output a variable DC voltage having absolute peak magnitude higher then absolute peak magnitude of the rectified AC output voltage;

wherein, the switching frequency and switching duty cycle being modulated, for at least a portion of a time associated with the low frequency, in proportion to a modulated instantaneous amplitude of the AC output voltage having effective magnitude proportional to a control signal provided at the control input means, and the high frequency oscillator is naturally and automatically synchronized with the an auxiliary resonant circuit formed by the auxiliary resonant inductance and the auxiliary capacitance means, in such a way, that the switching action, as well as the periodical manner of energy storage and release, being determined by the switching frequency and the switching duty cycle of the switching means.

14. A inverter device to supply a modulated magnitude of a high frequency signal to a gas discharge load equipped with filaments, the device being operable from a low frequency AC voltage source equipped with a dimmer means having a control input means and capable to provide modulated effective magnitude of an AC output voltage of continuous or noncontinuous waveshape at an AC output, the device comprising:

rectifier means receiving at a DC input the AC output voltage and providing at a DC output a pulsating DC voltage source having a pulsating DC voltage of absolute peak magnitude higher than absolute peak magnitude of the rectified AC output voltage;

unidirectional device means coupled to the pulsating DC voltage source;

energy storage means receiving energy from the pulsating DC voltage source via the unidirectional device and providing at DC terminals a relatively constant DC voltage; inverter circuit means coupled to the energy storage means and comprising: (i) semiconductor switching means operated by a control means, receiving the constant DC voltage, and operable in a periodical ON and OFF manner; and (ii) resonant oscillator means coupled to the semiconductor switching means and providing, in proportion to a control action provided at the control input means, the modulated magnitude of the high frequency signal to the gas discharge load;

wherein in response to the control action delivered to the control input means, a decrease of effective magnitude of the AC voltage causes a power magnitude delivered to the filaments of the gas discharge load to proportionally increase.

15. The device according to claim 12, 13 or 14, wherein the control means is as a feedback transformer made with a toroidal ferrite core and equipped with three separate windings with 1 to 6 turns each.

* * * * *